United States Patent [19]

Wellinghoff et al.

[11] Patent Number: 4,595,609

[45] Date of Patent: Jun. 17, 1986

[54] CORROSION RESISTANT TANTALUM PENTAOXIDE COATINGS

[75] Inventors: Stephen T. Wellinghoff; Ching Lin, both of Minneapolis, Minn.

[73] Assignee: Regents of the University of Minnesota, Minneapolis, Minn.

[21] Appl. No.: 673,865

[22] Filed: Nov. 21, 1984

[51] Int. Cl.[4] ..... B05D 3/02; B32B 9/00; B32B 15/04

[52] U.S. Cl. ..... 427/377; 106/287.18; 427/380; 428/469; 428/472

[58] Field of Search ..... 106/287.18; 423/592; 427/380, 377; 428/650, 655, 469, 472; 260/429 R

[56] References Cited

PUBLICATIONS

D. C. Bradley et al., Inorg. Chem. 3, 1163 (1964).

D. C. Bradley et al., Metal Alkoxides, Academic Press, NY (1978) at pp. 71-72, 100-102 and 117-119.

G. W. Stupian et al., Applic. Surf. Science, 9, 250-265 (1981).

K. A. Andrianov, Metalorganic Polymers, Interscience (1965), Ch. III, at pp. 109-119.

*Primary Examiner*—Michael R. Lusignan

*Attorney, Agent, or Firm*—Merchant, Gould, Smith, Edell, Welter & Schmidt

[57] ABSTRACT

Substrates having free surface hydroxyl groups, such as silaceous and aluminous materials, are rendered corrosion resistant by the application thereto of an amorphous, homogeneous tantalum pentaoxide coating layer.

13 Claims, 8 Drawing Figures

(3000X)

0.1 mm 0.1 mm 0.1 mm 0.1 mm 0.1mm 0.1mm

CORROSION RESISTANT TANTALUM PENTAOXIDE COATINGS

BACKGROUND OF THE INVENTION

The wide use of aluminum (Al) and its alloys to form structural members is due to advantages such as high strength to weight ratios, thermal and electrical conductivity, heat and light reflectivity and generally high corrosion resistance. However, aluminum is a very reactive metal, which is readily oxidized because of its high oxidation potential. The corrosion resistance of aluminum and its alloys in many environments is primarily due to the protective oxide film which rapidly attains a thickness of about 20 Å on fresh metal exposed to either air or water. However, in the absence of an oxide film, the corrosion rate can be very high. Aluminum rapidly corrodes in environments of both high and low pH, which cause uniform dissolution of the oxide and opens the underlying metal to attack.

In natural environments such as air, fresh water, sea water and soils, the surface oxide film is so stable and adherent that aluminum is inherently corrosion resistant. However, other methods of corrosion protection are required in environments contaminated with chlorine, chloride or other highly corrosive and abrasive agents. Dry chlorine reacts with aluminum to form a stable chloride, $AlCl_3$, which melts at about 192° C. $AlCl_3$ volatizes at relatively low temperatures because of its high vapor pressure. Consequently at 150° C. aluminum can be consumed by chlorine attack at rate of 1 μm or more per minute. Moreover, aluminum reacts more rapidly with moist chlorine than with dry chlorine. Therefore, aluminum and its alloys often fail in corrosive industrial environments in which high humidity and chlorine gas concentrations are employed.

There are a large number of surface treatments for corrosion protection of aluminum and its alloys. Commonly-employed methods include anodization and the use of organic coatings. Each of these procedures has its limitations. In anodization, aluminum is electrolytically oxidized and treated with hot water to form a nonporous coating of hydrated aluminum oxide thereon. Anodized aluminum is hard and resists corrosion, but not all aluminum alloys can be anodized to an acceptable appearance. Furthermore, anodizing is an energy intensive, difficult electrochemical process. Also, the brittle nature of the thicker films makes them susceptible to corrosion fatigue which causes local stress cracking and eventual rupture of the films. Clear organic coating compositions are an economically attractive choice for corrosion protection since they are easily handled and applied. But the organics are not effective for long term protection since gaseous molecules readily penetrate organic films and attack the underlying film-oxide interface.

Although tantalum pentaoxide films formed on polished Al single crystal surfaces by sputter deposition of tantalum and subsequent anodization effectively protect the Al from corrosion by water vapor saturated with chlorine, aluminum alloy surfaces are not protected, since the anodic film formed over grain boundaries, processing lines, and emergent precipitates is only weakly adherent, thus providing loci for stress corrosion cracks.

Therefore, a need exists for a method to protect corrosion-prone surfaces, particularly aluminum surfaces, by the application of a thin, ductile, chemically inert, dense and structurally homogeneous film.

BRIEF DESCRIPTION OF THE INVENTION

The present invention is directed to a method to impart corrosion resistance to a substrate by the application of a surface layer of tantalum pentaoxide ($Ta_2O_5$) thereto. The protective layer is formed in situ by coextensively coating the surface with a partially-hydrolyzed solution of a tantalum pentalkoxide in a volatile organic solvent such as a lower-n-alkanol. Upon evaporation of the solvent and exposure to water vapor, a prepolymeric film of tantalum oxide-alkoxide forms which cures at ambient temperatures to yield a uniform, amorphous layer of $Ta_2O_5$. Multiple coatings can be employed to produce layers which are smooth, extremely corrosion resistant, and which, in the case of metallic substrates, do not require pre-polishing of the metal surface to remain firmly bound thereto.

The production of $Ta_2O_5$ films by this solvent casting method has a number of advantages beyond its ability to produce the coating by a simple low temperature process. During formation of the $Ta_2O_5$ film, Ta—O—S (S = surface) bonds would readily form by condensation of Ta—$OC_2H_5$ and the S—OH bonds which are always present (e.g., $Al_2O_3$—OH), thus promoting interfacial adhesion. In fact, by casting the tantalum prepolymer onto any surface with significant numbers of unreacted OH groups, interpenetration and interreaction of the two oxides would occur, substantially eliminating the coating-surface interface. The low interfacial stresses present in the present solution-cast coatings can further assist the $Ta_2O_5$ films to resist detachment from the substrate.

Such films are particularly useful to provide effective anti-corrosion coatings on metallic articles such as thin aluminum sheets or films which are exposed aggressive environments where the application of thick anodic films and/or surface sealing with organic coatings is not practical. However, the present films also provide bases upon which polymeric coatings can be firmly adhered to impart further protection, adhesion, coloring or the like.

DETAILED DESCRIPTION OF THE INVENTION

Figure 1:
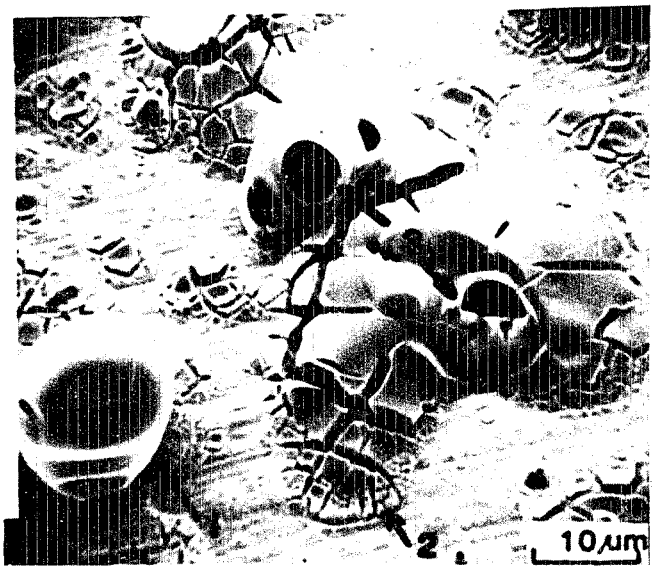
FIG. 1 is a scanning electron micrograph (SEM) depicting a corroded sheet of unprotected aluminum alloy.

Coating solutions useful in the present invention are solutions of tantalum lower ($C_1$-$C_3$) alkoxides in organic solvents. Although the corresponding lower alkanols are preferred as solvents for the tantalum alkoxides, other volatile organic solvents which can dissolve small amounts of water can also be employed, e.g. tetrahydrofuran, ethers, lower alkyl halides and the like. The preferred tantalum alkoxide coating solution comprises a solution of tantalum pentaethoxide [$Ta(OEt)_5$] in ethanol.

Preferably controlled amounts of water will be introduced into the $Ta(OEt)_5$ solution. The partial hydrolysis of the $Ta(OEt)_5$ produces soluble, tantalum oxide ethoxide polymer chains of varying length. It is believed that the hydrolysis of $Ta(OEt)_5$ yields ethoxide derivatives of tantalic acid of the general formula $Ta(OH)_x(OEt)_{5-x}$ wherein x is 1–4. Upon evaporation of the solvent a coating of a mixed tantalum oxide-ethoxide prepolymer is produced on the aluminum surface. Exposure of these coatings to ambient temperatures and humidities is effective to hydrolyze any remaining ethoxide to hydroxide which then rapidly condenses to $Ta_2O_5$ with loss of water.

Preferred $Ta(OEt)_5$-based coating compositions can be prepared by dissolving commercially-available $Ta(OEt)_5$ (99.999%, density=2.21 g/ml, Alfa Products, Danvers, MA) in absolute ethanol. Preferably about 0.1–1 vol-%, most preferably about 0.25–0.75 vol-% of $Ta(OEt)_5$ will be employed. To accomplish the partial hydrolysis of the $Ta(OEt)_5$ prior to its deposition on the substrate, water is mixed with the $Ta(OEt)_5$-ethanol solution under otherwise anhydrous conditions. Preferably about 0.75–5.0 moles of water per mole of $Ta(EOt)_5$ will be employed for the hydrolysis step, most preferably about 1.0–1.75 moles of water per mole of $Ta(OEt)_5$ will be employed.

The resultant ethoxy-tantalic acid coating solution is then applied to the surface by any convenient method, e.g., by dip-coating or spraying. A single application followed by evaporation of the solvent commonly yields a $Ta_20_5$ coating on aluminum of about 150–250 Å in thickness. Multiple dip coating is effective to build up coatings of any thickness desired, while aerosol mist coating at high ethanol vapor pressures can be useful to avoid loss of the coating composition due to runoff.

Upon evaporation of the ethanol, an unstable tantalum oxide (ethoxide) prepolymer film is produced. This film cures rapidly to yield a uniform, nonporous $Ta_2O_5$ film of high purity. Although the solvent evaporation can be accomplished employing external heating, curing to the final structure is complete in less than 1 min. at ambient temperatures and humidities, e.g. 18°–25° C., 40–60% relative humidity in air or nitrogen, for each 200 Å dip-coating step. Ellipsometer measurements showed that films made in air were thicker than those formed in a dry nitrogen environment.

The present $Ta_2O_5$ solution casting process is particularly effective to corrosion-proof commercially pure aluminum alloys with no surface pretreatment such as chemical or electrochemical polishing being required. Furthermore, the surface roughness of commercial aluminum foil and other metals can be substantially reduced by multiple castings of the Ta prepolymer. It is believed that smooth coated metal surfaces having a surface roughness of less than about 100 Å can be attained employing the present coating method. Such extremely flat surfaces minimize wear which can ultimately lead to the exposure of corrosion susceptible surfaces. Chemical vapor deposition and anodization are relatively ineffective in leveling surface defects.

$Ta_2O_5$ coated aluminum specimens were tested for corrosion resistance by exposing them to water vapor saturated with chlorine gas for predetermined time periods at 20° C. This test was performed by holding the specimens in a closed chamber above chlorine-saturated water. The specimens were then characterized by scanning electron microscopy (SEM) and X-ray photoelectron spectroscopy and/or X-ray fluorescence.

The invention will be further described by reference to the following detailed examples.

EXAMPLE I

CORROSION OF ALUMINUM ALLOY

Aluminum alloy 3003 (0.05 cm thick) foil sheets which were not chemically or electrochemically polished were directly exposed to the corrosive environment above chlorine-saturated water at 20° C. for 30 hours. The corroded metal surface was initially covered by a gelatinous product which eventually became gritty with time. The scanning electron micrograph (SEM) depicted in FIG. 1 reveals that many spherical protrusions obviously related to the gelatinous matter cover the surface. A few of the particulates show a tendency toward spheroidization indicating that large stresses develop due to volume change during phase transformation from solid Al to an apparently gelatinous material. The formation of cracks and voids in the protrusions intimately connected to the metal surface must arise from significant swelling stresses and the evolution of gaseous reaction products during corrosion.

Figure 2:
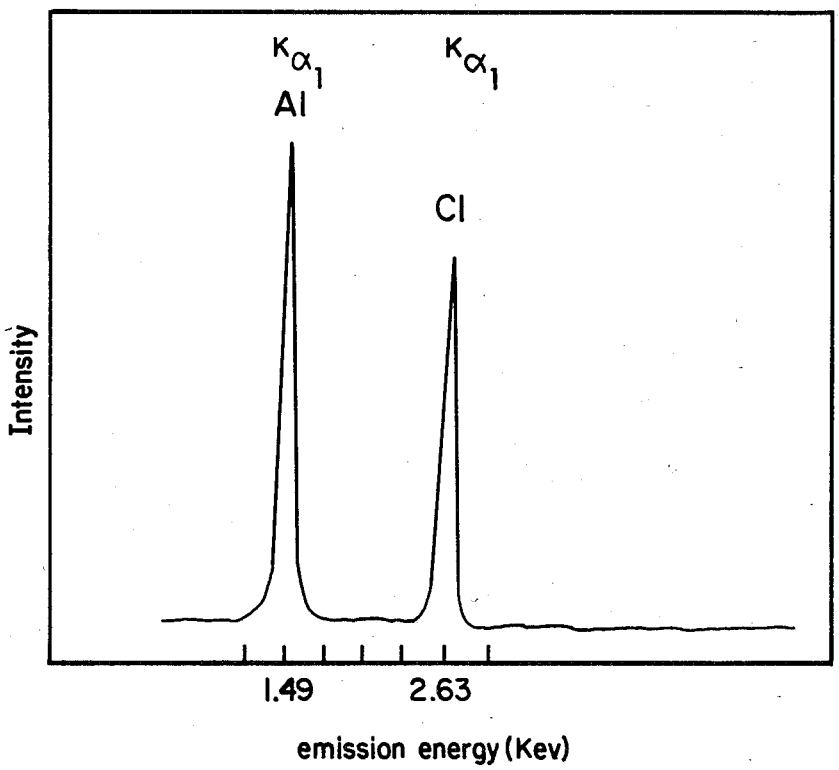
FIG. 2 is a graphical plot of the x-ray fluorescence obtained from the sheet depicted in FIG. 1.

FIG. 2 depicts a plot of the X-ray fluorescence obtained from the region of gelatinous morphology which demonstrates the presence of Al and Cl, elements which could be combined as either chlorides or oxychlorides of aluminum ($AlCl_3$, $Al(OH)Cl_2$, $Al(OH)_2Cl$).

Apparently, chlorine attack upon the surface initiates at localized defects or flaws in the natural $Al_2O_3$ film which overlays the metallic aluminum. Therefore, a defect free oxide coating such as that provided by the present method is necessary to prevent the aluminum alloys from corrosion in the aggressive water-chlorine environment.

EXAMPLE II

PREPARATION OF TANTALUM PENTAOXIDE FILMS

A. Coating Process

Commercially pure aluminum foils (99.0% aluminum, 2.54 cm. sq.) were degreased with trichloroethylene in an ultrasonic bath at room temperature for 2 to 5 minutes, rinsed with distilled water and then rinsed with ethanol.

Absolute ethanol which was dryed over molecular sieves and Mg, was used as a solvent for $Ta(OEt)_5$ (99.999%, from Alpha Products). $Ta(OEt)_5$ was placed in a dry flask under a dry nitrogen gas atmosphere and was diluted to 0.1 vol-% by adding dry EtOH. A small amount of water was added to the above solution under dry nitrogen to yield a final mole ratio of water:$Ta(OEt)_5$ of 1.5:1.

2.0 ml portions of the coating solution withdrawn by hypodermic needle and applied to the foil surface were allowed to air dry at 25° C. (50% relative humidity) for 0.5–1.0 hr. In this manner, foils with $Ta_2O_5$ film thicknesses of 150 Å (one application) and 400 Å (three applications) were prepared. The thickness of the tantalum coatings was determined by ellipsometry.

B. Corrosion Tests

All the coated Al foils were exposed to a wet $Cl_2$ environment in a closed system containing water vapor saturated with 0.47 mol % $Cl_2$. All the specimens were exposed for a predetermined amount of time at 20° C. and then investigated by SEM. C.

Scanning Electron Microscopy and X-ray Photoelectron Spectroscopy (XPS)

A Cambridge SEM, Model MARK 2A, was used to examine surface morphology of oxide films on Al substrates both before and after being exposed to the wet $Cl_2$ environment. Because of the large depth of focus and large working distance, SEM permits direct examination of rough conductive samples without additional preparation. In our case, each specimen (nonconductive oxide film on Al substrate) was mounted on SEM stubs and coated with carbon to obtain a sharp image without charging problems. The Physical Electronics XPS Model 555 was employed to analyze the thin $Ta_2O_5$ films. In this instrument MgKa (1253 eV) was used as the source of excitation to produce photons.

D. Results and Discussion

Table I qualitatively summarizes the results observed via SEM examination of coated and uncoated foil (Ex. I) after exposure to the chlorine-water environment for 30, 60 and 100 hours at 20° C.

Table I--Corrosion Study of Solution-deposited $Ta_2O_5$ on Al Substrates

TABLE I

| Corrosion Study of Solution-deposited $Ta_2O_5$ on Al Substrates | | | |
|---|---|---|---|
| | Example | | |
| Exposure conditions | I Al foil | IIA $Ta_2O_5$/Al foil (150Å) | IIB $Ta_2O_5$/Al foil (400Å) |
| Wet $Cl_2$ 30 hours 20° C. | severly corroded | no corrosion | no corrosion |
| Wet $Cl_2$ 60 hours 20° C. | severly corroded | locally corroded | no corrosion |
| Wet $Cl_2$ 100 hours 20° C. | severly corroded | not tested | no corrosion |

Figure 3:
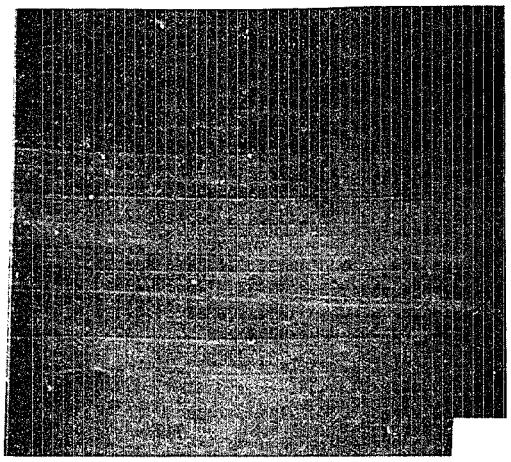
FIG. 3 is a SEM depicting an uncoated aluminum sheet prior W to treatment according to the invention.
Figure 4:
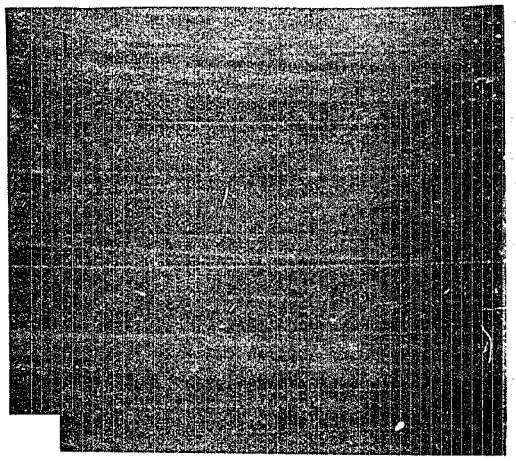
FIGS. 4, 5 and 7 are SEM's depicting aluminum sheets coated by the method of the invention.

The solution-deposited 150 Å $Ta_2O_5$ film on Al foil showed no visible change after being exposed to wet $Cl_2$ at 20° C. for 30 hours. The SEM micrograph (FIG. 4) shows a smooth surface with no cracks or corrosion products except for processing lines which were readily identified by their dimension of about 20 μm or more. The micrograph (FIG. 3) of unexposed uncoated Al substrate clearly reveals the existence of the same processing lines. The corrosion protection by the oxide film may be attributed to the insolubility and stability of the $Ta_2O_5$ in the $Cl_2/H_2O$ environment, which provides a barrier layer to protect the underlying metal from $Cl_2/H_2O$ attack.

Figure 5:
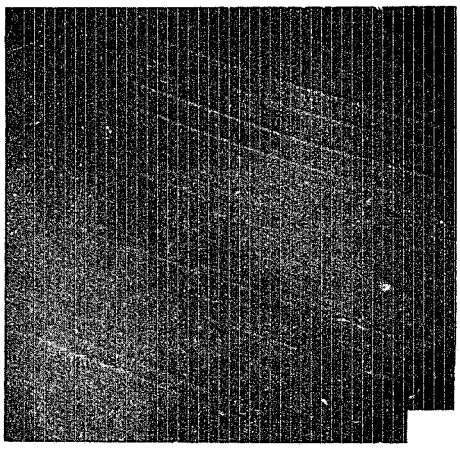
Figure 6:
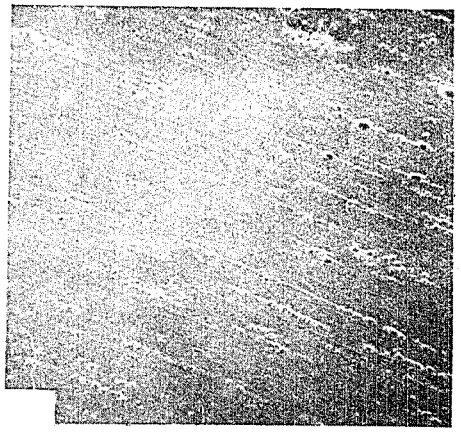
FIGS. 6 and 8 are SEM's depicting aluminum sheets coated by the method of the invention following exposure to a corrosive environment.
Figure 7:
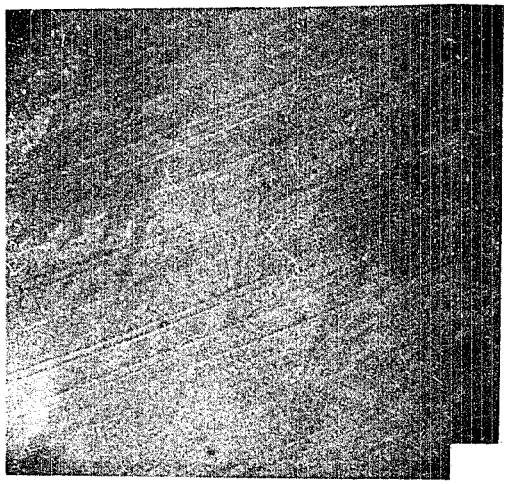
Figure 8:
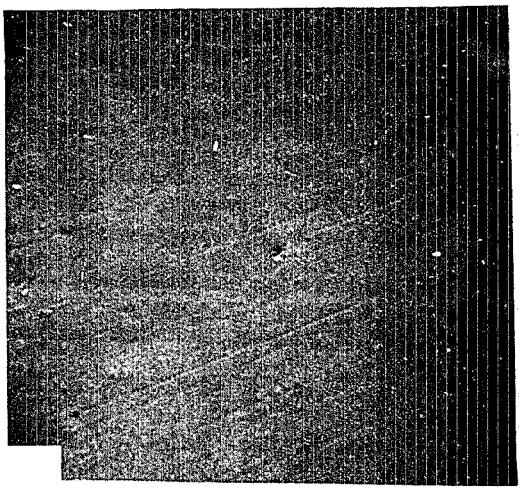

After being exposed to wet $Cl_2$ at 20° C. for 60 hours, the specimen of Ex. IIA showed no visible change. An SEM micrograph (FIG. 6) revealed white spots distributed along the processing lines on the surface which were not present in the SEM of the coated, unexposed specimen (FIG. 5). X-ray fluorescence obtained from the region of white spot indicates the presence of Al and Cl elements which could be either chlorides or oxychlorides of aluminum. It is plausible that locally ultrathin oxide films (ca.50 Å) may be formed at the substrate process lines. The weak spots of the ultrathin oxide layer may eventually provide for penetration of $Cl_2$ and $H_2O$ through the oxide and attack of the underlying Al metal. This problem can be overcome by increasing the thickness of the oxide by, the application of multiple oxide coats. The SEM of FIG. 8 shows that the sample of Ex. IIB exhibits a smooth surface with the absence of white spots after being exposed to wet $Cl_2$ at 20° C. for 100 hours. FIG. 7 is an SEM depicting the coated, unexposed surface. This result also provides confirmation for the proposed corrosion mechanism described above.

The durability of a coating is of prime importance in the field of corrosion protection. Thus degree of adhesion and the ability of the film to deform and relieve stress without cracking is quite important. The adhesion of the $Ta_2O_5$ film on the Al substrate is so strong that no wrinkling or detachment is observed, either before or after exposure to the corrosive environment.

An X-ray photoelectron spectroscopy (XPS) survey showed that all of the $Ta_2O_5$ films on the Al substrates consist substantially of C, O, and Ta elements.

Although the invention has been exemplified by the coating of aluminum alloy foils with $Ta_2O_5$, it is expected that the present method will be applicable to the corrosion protection of a wide variety of organic and inorganic substances which possess sufficient surface hydroxyl groups to form reactive sites for the tantalum prepolymer. Among the substances which would be expected to meet this requirement are other metals such as single crystal aluminum, magnesium, nickel, titanium and their alloys; natural and synthetic minerals comprising surface Si—OH groups, such as feldspar minerals, clays, quartz, aluminas, diatomaceous earths, sands, glasses, naturally-occurring and synthetic zeolites, zircon, carborundum, pumice and the like, which may be used singly or in mixtures. Polymeric organic substrates such as epoxide resins, oxidized polypropylene, polyimide and the like also provide suitable substrates for the solution-cast $Ta_2O_5$ films.

Finally, the $Ta_2O_5$ films are expected to provide ideal substrates for a wide variety of organic barrier coatings, which can impart supplemental corrosion protection to the metallic surface. Such coatings include paints, varnishes and lacquers.

The invention has been described by reference to certain specific embodiments and detailed examples. However, as would be apparent to one of skill in the art, many modifications may be made while remaining within the spirit and scope of the invention.

What is claimed is:

1. A method of imparting corrosion resistance to a substrate having free surface hydroxyl groups; said method comprising:
   (a) coating said surface coextensively with a partially-hydrolyzed solution of Ta[(lower)alkoxide]$_5$ in an organic solvent;
   (b) evaporating said solvent to yield a tantalum oxide-ethoxide film; and
   (c) curing said film to yield a uniform, amorphous tantalum pentaoxide layer on said surface.

2. The method of claim 1 wherein said substrate surface comprises Al—OH groups or Si—OH groups.

3. The method of claim 2 wherein said substrate surface comprises aluminum.

4. The method of claim 2 wherein said substrate surface comprises a polyimide.

5. The method of claim 1 wherein said Ta[(lower)alkoxide]$_5$ comprises $Ta(OEt)_5$ and said organic solvent comprises ethanol.

6. The method of claim 5 wherein said solution comprises about 0.1–1 vol-% $Ta(OEt)_5$.

7. The method of claim 5 wherein the $Ta(OEt)_5$ has been partially hydrolyzed by the addition to said solution of about 0.75–5 moles of water per mole of $Ta(OEt)_5$.

8. The method of claim 1 wherein said film is cured by exposure of the film to water vapor and ambient temperatures.

9. The method of claim 1 wherein said tantalum pentaoxide layer is at least about 150 Å thick.

10. A method of imparting corrosion resistance to a substrate incorporating an aluminum surface comprising:

(a) preparing a solution of about 0.25–0.75 vol-% $Ta(OEt)_5$ and water in absolute ethanol, wherein mole ratio of water:$Ta(OEt)_5$ is about 0.75–5;

(b) coating said surface coextensively with said soution;

(c) evaporating said ethanol from said solution coating to yield a prepolymer film; and (d) curing said prepolymer film in the presence of moisture to yield an amorphous, homogeneous $Ta_2O_5$ layer on said aluminum surface.

11. The method of claim 10 wherein said $Ta_2O_5$ layer is about 150–400 Å thick.

12. The method of claim 11 wherein an organic barrier coating is applied to said $Ta_2O_5$ layer.

13. The method of claim 10 wherein said prepolymer film is cured by exposure of said prepolymer film to ambient temperatures and humidities.

* * * * *

UNITED STATES PATENT AND TRADEMARK OFFICE

CERTIFICATE OF CORRECTION

PATENT NO. : 4,595,609

DATED : June 17, 1986

INVENTOR(S) : Stephen T. Wellinghoff et al.

It is certified that error appears in the above-identified patent and that said Letters Patent is hereby corrected as shown below:

Cover page, names of inventors, for "Ching Lin" read --Yeong Ching Lin--.

At Column 2, line 52, for "prior w to" read --prior to--.

At Column 5, line 2, for "by SEM.C." read --by SEM.--.

At Column 5, line 4, for "Scanning Electron" read --C. Scanning Electron--.

At Column 6, line 3, for "by, the" read --by the--.

At Column 8, lines 3-4, for "wherein mole" read --wherein the mole--.

At Column 8, line 4, for "said sou-" read --said solu---.

Signed and Sealed this

*Thirtieth* Day of *September 1986*

[SEAL]

*Attest:*

DONALD J. QUIGG

*Attesting Officer*

*Commissioner of Patents and Trademarks*